United States Patent [19]

Metrailer

[11] 4,244,805

[45] Jan. 13, 1981

[54] LIQUID YIELD FROM PYROLYSIS OF COAL LIQUEFACTION PRODUCTS

[75] Inventor: William J. Metrailer, Baton Rouge, La.

[73] Assignee: Exxon Research & Engineering Co., Florham Park, N.J.

[21] Appl. No.: 45,683

[22] Filed: Jun. 5, 1979

Related U.S. Application Data

[63] Continuation of Ser. No. 883,356, Mar. 6, 1978, abandoned, which is a continuation-in-part of Ser. No. 711,706, Aug. 5, 1976, abandoned.

[51] Int. Cl.[3] ..... C10G 1/00; C10G 57/00; C10G 9/28

[52] U.S. Cl. ..... 208/8 LE; 208/50; 208/127

[58] Field of Search ..... 208/8, 50, 127

[56] References Cited

U.S. PATENT DOCUMENTS 3,841,991 10/1974 Cohen et al. ..... 208/8

3,997,422 12/1976 Bull et al. ..... 208/8

FOREIGN PATENT DOCUMENTS 730030 5/1955 United Kingdom .

*Primary Examiner*—Delbert E. Gantz
*Assistant Examiner*—William G. Wright
*Attorney, Agent, or Firm*—James H. Callwood; Edward H. Mazer

[57] ABSTRACT

The quantity and quality of liquids produced from solid coal can be enhanced by a process comprising a liquefaction zone and a pyrolysis reactor, preferably a fluid coking zone, wherein the heavy liquids obtained in the pyrolysis reactor, e.g., 1000° F.+ materials having a Conradson Carbon content of at least 15 wt. % are recycled to the liquefaction zone, rather than to the pyrolysis reactor, for further treatment under hydrogenation conditions and, consequently, conversion of the heavy liquids to lower boiling liquids which may be removed from the pyrolysis reactor feed by distillation is achieved.

16 Claims, 1 Drawing Figure

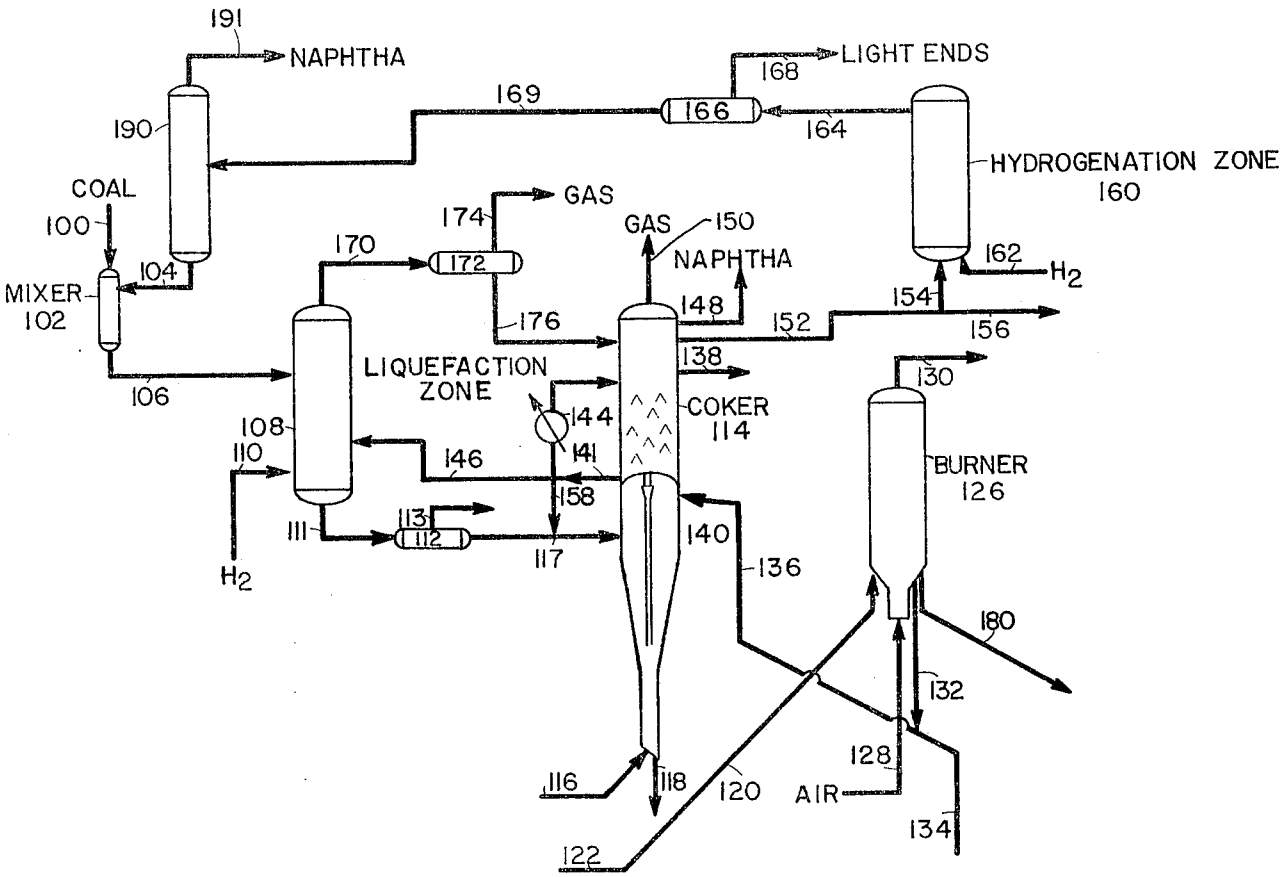
HYDROGENATION ZONE
160
LIGHT ENDS
NAPHTHA
GAS
GAS
NAPHTHA
COKER
114
BURNER
126
LIQUEFACTION
ZONE
COAL
MIXER
102
AIR
$H_2$
$H_2$
100
102
104
106
108
110
111
112
113
114
116
117
118
120
122
126
128
130
132
134
136
138
140
141
144
146
148
150
152
154
156
158
160
162
164
166
168
169
170
172
174
176
180
190
191

LIQUID YIELD FROM PYROLYSIS OF COAL LIQUEFACTION PRODUCTS

CROSS REFERENCE TO RELATED APPLICATIONS

This is a continuation, of application Ser. No. 883,356, filed Mar. 6, 1978 now abandoned, which is a application is a continuation-in-part of copending application Ser. No. 711,706 filed Aug. 5, 1976 now abandoned.

FIELD OF THE INVENTION

This invention relates to the enhancement of the quality and quantity of liquid products obtained from solid coal. More particularly, this invention relates to a liquefaction process wherein all or any portion of the liquid product from coal liquefaction is subjected to pyrolysis in a pyrolysis reactor, preferably a fluid coking zone, and high boiling liquids obtained in the pyrolysis reactor are recycled to the coal liquefaction zone for further treatment and conversion to lower boiling liquids. Recycle of the higher boiling liquids to the liquefaction zone rather than the usual internal recycle within the coking zone effectively eliminates a substantial portion of these materials from the coking zone thereby improving the quantity and quality of the liquid products and substantially reducing the coke make from the coking zone.

BACKGROUND OF THE INVENTION

The treatment of solid coal to obtain liquids therefrom has been extensively developed and a variety of coal liquefaction processes have been reported. These processes include solvent refining, direct hydrogenation of coal, catalytic or noncatalytic hydrogenation in the presence of a hydrogen donor solvent and catalytic or noncatalytic hydrogenation in the presence of a vehicle or nondonor material. Generally, these processes can be characterized as involving substantial chemical conversion of the coal as opposed to solvent extraction with solvents such as pyridine, benzene, tetrahydrofuran, etc. In coal liquefaction, conversion of the coal is normally effected at elevated pressures and elevated temperatures, e.g., above 150° C., preferably above about 250° C., while solvent extraction is normally effected at room temperature or temperatures up to the boiling point of the solvent employed.

Coal liquefaction processes wherein a coking zone is incorporated to treat the heavier or bottoms portion of the liquids from the liquefaction reactor have been extensively reported. For example, U.S. Pat. No. 3,617,513 discloses a coal liquefaction process wherein a fluid coker is employed to enhance liquid product yield. The bottoms stream comprising depleted donor solvent, heavy liquids and unconverted or unreacted coal is sent to the fluid coking zone from which light gases, liquids and coke are recovered. In the coking zone, heavy liquids, e.g., 1000° F.+ are removed from a distillation tower located immediately above the coking zone for further conversion. Since coke precursors include high boiling condensed ring aromatic molecules, the coke precursors will be recycled to the coking zone. It has now been discovered, however, that by recycling these heavy materials to the liquefaction zone where the materials are treated under hydrogenation conditions, the yield and quality of the liquid products of the process are enhanced considerably.

DISCUSSION OF THE PRIOR ART

A number of patents have issued in which coking of liquefaction products is disclosed. For example, and as mentioned, U.S. Pat. No. 3,617,513 discloses the fluid coking of coal liquids wherein the 1000° F.+ product stream is recycled to the coker for further conversion in the coker. A similar system is shown in U.S. Pat. No. 3,841,991 wherein high boiling heavy liquids are recovered overhead of the coking zone and mixed with feed to the coker for re-introduction to the coking zone.

Also, U.S. Pat. No. 3,503,864 shows the recycle of a solvent stream, usually a 400°–700° F. stream to the liquefaction zone, for use of its solvating properties. This recycle stream will usually be removed in the flash or distillation that the liquefaction liquid products are subjected to after the coal liquefaction step. Thus, this recycle stream will usually never be returned to the coking zone for further treatment. Moreover, even if returned to the coking zone, this low boiling stream will simply vaporize and pass through the coking zone unaffected. Thus, no enhancement of liquid yield is obtained by treatment of these low boiling liquids in a coking zone. A similar scheme is shown in U.S. Pat. No. 3,240,566 where solvent is recycled from the coker to the liquefaction zone. While many process schemes show coking zones and the recycle of solvent boiling range material to the liquefaction zone, the recycle of heavy liquids is normally back to the coking zone for conversion within the coking zone.

SUMMARY OF THE INVENTION

Now, in accordance with this invention, an improved process for producing liquids from solid coal is provided which, in essence, comprises a coal liquefaction zone and a pyrolysis zone, preferably a fluid coking zone, wherein there is effective interaction between the zones to enhance the quality and quantity of useful liquid products and reduce the coke make from the coking zone. Thus a high boiling, preferably 1000° F.+ stream having a Conradson Carbon content of at least 15 wt. %, more preferably a high boiling stream having a Conradson Carbon content of at least 20 wt. % wherein at least 50 mole percent of the stream boils above 1050° F. is recovered from the coking zone and at least a portion thereof is recycled to the liquefaction zone where it is further treated under liquefaction conditions. In contrast to previous methods, where the high boiling stream from the coker was recycled to the coking zone for further conversion, the high boiling stream is now substantially upgraded in the liquefaction zone before returning to the coker. In the liquefaction zone, the high boiling stream is subjected to liquefaction conditions which include an environment for promoting hydrogenation reactions. As a consequence, this high boiling stream is converted either to upgraded and lighter boiling fractions (which may be subsequently removed as liquid product by distillation) or to fractions containing a higher hydrogen to carbon ratio. In either case, however, coke production in the coking zone is measurably decreased since the high boiling liquids (containing substantial amounts of coke precursors such as condensed ring aromatic structures) have been broken down into lower boiling components (and removed) or to more hydrogenated forms that are less susceptible to coke formation and more susceptible to cracking to valuable liquid products. Liquid product quality and quantity are thereby enhanced.

In various embodiments of this invention, a solid coal is suitably prepared as by grinding and drying, slurried in a vehicle, preheated, and subjected to liquefaction conditions. Liquefaction generally comprises elevated tempertures and pressures and the presence of hydrogen either in the molecular form or available from a hydrogen source, such as a hydrogen donor diluent or solvent. Generally, hydrogen donors are rendered more effective in coal liquefaction when some molecular hydrogen is also present. The products of the liquefaction zone, light gases, liquids and unconverted coal (including ash) are recovered. Generally, the gases are separately recovered and one or more liquid streams are also separately recovered. Thus, an intermediate boiling liquid product stream containing light liquids, e.g., naphtha, diluent for recycle, and product liquid for further upgrading (as by hydrotreating, e.g., hydrocracking, hydrodesulfurization, reforming, etc.) may be separately recovered as well as a bottoms stream containing unconverted or unreacted coal and heavy liquids. The split between the intermediate liquid stream and the bottoms stream will be one virtually of choice since the coking zone will not normally affect materials boiling below about 800°/850° F. but sufficient liquid will be necessary in order to pump the bottoms stream to the coker (as a slurry).

In the pyrolysis zone, the overhead vapors are usually partially condensed and light gases, light liquids and gas oils are recovered. Heavy liquids, depending upon the desired cut point, are usually recycled to the pyrolysis zone for further conversion. In some instances, the heavy liquids which are withdrawn are cooled, condensed in a scrubber and recycled as a quenching medium to condense the overhead vapors from the coker. The quench also serves to scrub any solids that remain in the overhead vapors. Instead of internally recycling the heavy liquids (with or without scrubbed solids) to the pyrolysis zone, these heavy liquids or a portion thereof are recycled to the liquefaction zone for further treatment under liquefaction conditions.

Generally, the cut point of the recycle heavy liquids will be a matter of choice and can be raised since these heavy liquids have some limited market value as furnace fuel, for asphalt manufacture, or disposal as heavy fuels, e.g., bunker fuels, when fluxed with lighter components. Normally, however, the heavy liquids will be 1000° F.+ materials having a Conradson Carbon content of at least 15 wt. %, preferably materials wherein at least 50 mole % boils above 1050 and having a Conradson Carbon content of at least 20 wt. %. A portion of the heavy liquids may be used as a quench by a recycle pumparound system and thereby contain unconverted solids. In either case, i.e., with or without solids, at least a portion and preferably at least a major portion, of these heavy liquids are recycled to the liquefaction zone.

Coal to the process may be any type of coal, such as bituminous, sub-bituminous, lignite, brown coal, etc., and is generally ground to a finely divided state. Coal particles will generally be in the range of ¼" to 325 mesh, U.S. sieve series scale. The use of particles about 8 mesh or smaller is normally preferred. A typical inspection of a coal suitable for use in this invention is shown in Table I of U.S. Pat. No. 3,617,513 which table is hereby incorporated by reference.

Generally, any type of liquefaction process, i.e., where substantial chemical reactions occur, can be utilized. Thus, solvent refined coal, as typified by the Pittsburgh and Midway Coal Company process (PAMCO process) can be employed as well as catalytic or noncatalytic processes employing hydrogen donor solvents or non-donor solvents. A source of hydrogen is necessary and hydrogen can be supplied either as molecular hydrogen or from a hydrogen donor solvent, e.g., tetralin and related compounds, or both. Liquefaction is generally effected at elevated temperatures and pressures, e.g., 600°–1000° F., 500–5000 psig, and the reaction proceeds for a period sufficient to liquefy (as materials that are soluble in methylethyl ketone) a substantial portion of the coal, for example, at least about 25% on a moisture and ash-free basis (m.a.f.), preferably at least about 50%.

A preferred coal liquefaction process is the hydrogen donor solvent process, preferably conducted in the presence of hydrogen, that is, about 0.1 to 4 wt. % hydrogen based on m.a.f. coal charged to the liquefaction zone. The hydrogen donor solvent generally comprises a wide boiling fraction, e.g., 375° F. to about 800° F. The boiling range is not critical except insofar as maintaining the hydrogen donor molecules of the solvent in the liquid phase during liquefaction. Preferably, the solvent contains at least about 30 wt. %, more preferably at least about 50 wt. % of compounds that are well known hydrogen donors under liquefaction conditions. Thus, the solvent is composed of both donor and non-donor compounds.

Preferred hydrogen donor compounds include indane, $C_{10}$–$C_{12}$ tetralins, $C_{12}$–$C_{13}$ acenaphthenes, di-, tetra-, and octa-hydroanthracene, and tetrahydroacenaphthene as well as other derivatives of partially saturated hydroaromatic compounds. A typical inspection of a suitable donor solvent obtained from coal liquefaction is shown in Table II of U.S. Pat. No. 3,617,513 which table is hereby incorporated herein by reference.

The hydrogen donor solvent is employed in a weight ratio of 1/1 and 4/1 based on coal charged to the liquefaction zone, preferably 1/1 to 2/1.

Liquefaction conditions for the donor solvent process may vary widely, e.g., 650° to 1000° F., 300 to 3000 psig, preferably about 700° F. to 900° F. and 1200 to 2500 psig. The products of the liquefaction zone, regardless of the liquefaction process employed, will comprise light hydrocarbon gases along with some $H_2S$, CO and $CO_2$ and a slurry liquid containing the unconverted or unreacted coal. The slurry liquid is normally processed by flashing (which serves to lower the pressure on the stream and remove, by vaporization, a portion of the liquids contained therein) and distillation and, generally, three liquid streams are recovered. That is, a product stream boiling below about 700° F. is recovered and used for upgrading by normal refinery processes. A second stream boiling between about 700° and 1000° F. can also be recovered and a portion thereof can be hydrogenated and recycled to the liquefaction zone as hydrogen donor solvent. The 1000° F.+ material can be introduced directly to the coking zone. One skilled in the art will readily see that various processing schemes can be realized for the liquid product from the liquefaction zone. These will depend on product demand, recycle solvent, economics, etc. However, to produce a 1000° F.+ stream, a vacuum distillation tower is required. The cut point on a vacuum distillation tower will be a matter of choice depending upon having enough liquid to pump the bottoms stream to the coking zone and whether operations dictate the cracking of some of the heavy liquids from the liquefaction zone. Thus, the feed to the coking zone could easily be an 800° F.+ stream, preferably a 900° F.+ stream, more preferably a 950° F.+ stream or higher, e.g., 1000° F.+.

The pyrolysis zone can be any type of thermal cracking zone such as a delayed coker but is preferably a fluid coking zone. Fluid cokers are relatively conventional pieces of equipment and have been described in available literature. For example, U.S. Pat. Nos. 3,617,513 and 3,841,991 both describe coking of coal liquids in fluid cokers. The bottoms stream slurry is fed directly into the coking zone wherein a bed of heated coke particles is maintained in a fluidized state. The vaporous and gaseous products are removed overhead as a coker distillate and fractionally distilled.

Heat for the coking reaction is supplied by continuously removing a portion of the coke from the coking zone and burning a part thereof in a coke burner with air. The remaining heated coke particles are turned to the coking zone at a temperature about 100° F. higher than the operating temperatures of the coking zone. Coking zone operating conditions can vary from 900° to 1300° F. or higher with pressures of 0 to 75 psig. A superficial gas velocity 0.5 to 4.0 feet/second maintains the coke bed in a fluidized condition. The particle size of the coke ranges from about 10 to 1000 microns with a fluidized bed density of about 15 to 60 pounds per cubic foot, and a space velocity of about 0.1 to 10 w/hr/w. The coke burner operates at similar pressures and gas velocities but at temperatures slightly higher than the coking zone so as to provide heat for the endothermic coking reaction.

Referring now to the drawing, particulate coal is introduced by way of line 100 into a mixer 102 wherein it is combined with a recycle donor solvent stream introduced by way of line 104 to form a coal/solvent slurry with a weight ratio of about 1.2 solvents per weight of coal. The slurry is conducted by way of line 106 to liquefaction zone 108 at typical liquefaction conditions of 840° F. and 1500 psig. Hydrogen (about 2 wt. % based on m.a.f. coal) is introduced via line 110. Within the liquefaction zone 108 hydrogen is transferred to the coal and pyrolysis zone bottoms recycle from the donor solvent. Additional hydrogen may be required since hydrogen will be transferred to the bottoms recycle as well as the coal. Thus, about 2 wt. % hydrogen based on recycle liquid will suffice.

The liquid product, including unreacted coal, is removed as a slurry via line 111 and transported to fluid coker 114. The flash vessel 112 is utilized to lower the pressure between the liquefaction zone 108 and the fluid coker 114. Flashed liquids are removed as product via line 113 and the remainder is passed to the coker via line 117. Flash vessel 112 may be an atmospheric distillation tower and may also represent an atmospheric and vacuum distillation tower where lighter components are removed. The cut point of the material, as mentioned, is one of choice but is preferably 900° F.+, more preferably 950° F.+ or higher, e.g., 1000° F.+.

The slurry feed in coker 114 is subjected to cracking conditions at about 1050°/1100° F. The coke bed is maintained in a fluidized condition by steam introduced via line 116. A portion of the coke from coker 114 is withdrawn via line 118 and is carried through line 120 by an entraining gas stream such as steam in line 122 and introduced into coke burner 126. Air in line 128 maintains the bed of coke in a fluidized state and is also used to combust a portion of the coke in burner vessel 126. Flue gas is removed via line 130 while hot coke particles are removed via line 132 entrained in a gas stream such as steam in line 134 and introduced into the coker 114 by way of line 136.

The vaporous products from coker 114 pass upwardly through a cyclone separator 140 where almost all of the entrained coke is separated and returned through the cyclone dipleg to the fluidized bed in the coking zone. The vaporous products are fractionated in a distillation column (suitably mounted directly above the coker vessel) and a heavy liquid boiling at 1000° F.+ and having a Conradson Carbon content of at least 15%, preferably at least 50 mole % boiling above 1050° F. and having a Conradson carbon content of at least 20 wt. % withdrawn as the vapor via line 141, cooled on external heat exchanger 144 and a portion of the cooled condensed heavy liquid is recycled to the coker fractionator above coker 114 to act as a quench for the overhead vaporous products. Another portion of the condensed heavy liquid is recycled to the liquefaction zone 108 through line 146 for further treatment under hydrogenation conditions as previously mentioned. Alternatively, a portion of the heavy liquids may be reintroduced into the coking zone for further coking treatment via line 158.

The fractionation may also be used to produce a 700°/1000° F. gas oil stream in line 138, a naphtha stream boiling up to about 400° F. in line 148 and a gas stream in line 150. A recycle solvent stream boiling in the range of about 400°/700° F. is removed via line 152 and at least a portion thereof is recycled after hydrogenation for use as hydrogen donor solvent by way of line 154. Product may be recovered in line 156 for further upgrading.

The recycle solvent is hydrogenated in hydrogenation zone 160 with hydrogen from line 162 in the presence of a suitable hydrogenation catalyst, e.g., cobalt molybdate supported on an alumina support, and under hydrogenation conditions such as temperatures ranging from about 650° F. to 850° F., e.g., 700° F., pressures ranging from about 650 to 2000 psig, e.g., 1350 psig, space velocity of about 1 to 6 w/hr/w and a hydrogen feed per barrel of feed of about 1000 to 10,000 scf/barrel, e.g., 5000 scf/barrel. Hydrogenated solvent is removed via line 164 and may be passed through a flash separation zone 166 for the removal of hydrogen and light ends via line 168. The liquid is then transported in line 169 to stripper 190 where naphtha is removed via line 191. Solvent leaves the stripper via line 104 and is recycled into mixer 102.

If desired, gaseous products from the liquefaction zone 108 can be removed by line 170 passed through a separator 172 and a gas stream removed by line 174. Light hydrocarbons from the gas stream may be removed in line 176 and introduced into the fractionating tower located above the fluid coker 114 for fractionation along with the products of the coker.

In another embodiment, not shown, a portion of the coke may be removed from the coker or coke burner and reacted with steam for the production of hydrogen which can then be used within the process in liquefaction zone 108 and solvent hydrogenation zone 160.

In a further embodiment, also not shown, the heavy coker liquids may be mixed with fresh coal feed rather than being directly injected into the liquefaction zone.

The plastic mix could then be fed to the liquefaction zone or the mixing zone and may be a desirable way to move fresh coal continuously into a high pressure vessel, e.g., liquefaction zone.

EXAMPLE

The bottoms (1000° F.+ material, designated CSKB-7501) from a microlube distillation of the liquids produced during the coking of liquefaction bottoms (produced by liquefaction of Illinois coal in the presence of hydrogen and tetralin—a donor diluent solvent) were liquefied in a tubing bomb. The liquefaction conditions of the tubing bomb were:

2 tetralin/solid feed
800° F.
130 minutes residence time
1.6 wt. % hydrogen gas
1500 psig final pressure The resultant liquefaction product was a homogeneous solution with low viscosity. 0.14 wt. % hydrogen gas was consumed. The liquefaction yields were:

| | |
|---|---|
| $H_2O$ | 2.61% |
| gas | 2.89% |
| $CO_x$ | 0.83% |
| $C_1$-$C_3$ | 2.06% |
| solid residue | 41.51% |
| liquid | 53.13% |

The solid residue was based on cyclohexane insoluble. To correlate the cyclohexane insoluble to 1000° F.+ material, a blank cyclohexane solubility test of the solid feed was carried out. The blank test showed 5.0 wt. % of solid feed are cyclohexane soluble. Thus, the 1000° F.+ material was estimated to be 41.5+5.0=46.5% and the liquid yield 53.13−5.0=48.13%.

Analysis of the product was carried out by three different techniques:

| | original 1000° F.− material in feed wt. % feed as analyzed | Liquid make wt. % Feed | Liquid make wt. % 1000° F.+ |
|---|---|---|---|
| cyclohexane was | 8.2 | 53.1 | 48.9 |
| GC distillation | 13.4 | 48.0 | 40.0 |
| mass spectrometer analysis | 29.0 | 62.1 | 46.6 |

A conservative estimate is that under the above-mentioned liquefaction conditions, 40 wt. % of additional liquid can be made from the microlube distillation bottoms of fluid coking liquids. The converted liquids represent about 3.0 wt. % of fresh feed coal.

What is claimed is:

1. In a process for producing liquids from a coal feed which comprises liquefying the coal in a liquefaction zone under liquefaction conditions including the presence of hydrogen or a hydrogen donating material, recovering a liquid bottoms product from the liquefaction zone which comprises unconverted coal and coal derived liquids, passing the liquid bottoms product through a flash vessel to remove flashed liquids and thereafter passing the remainder to a coking zone and coking therein at least a portion of the bottoms product the improvement which comprises recovering a high boiling stream boiling at 1000° F.+ and having a Conradson Carbon content of at least 15 wt. % from the coking zone, recycling at least a portion thereof to said liquefaction zone and converting said high boiling stream in said liquefaction zone into lighter boiling fractions or to fractions containing a higher hydrogen to carbon ratio.

2. The process of claim 1 wherein at least 50% of the high boiling stream being recycled to the liquefaction zone boils above about 1050° F.

3. The process of claim 2 wherein the high boiling stream from the coking zone is condensed externally to the coking zone and a portion thereof is returned to the coking zone as a quench stream for the vaporous overhead product from the coking zone.

4. The process of claim 2 wherein the high boiling stream from the coking zone has a Conradson Carbon content of at least 20 wt. %.

5. The process of claim 3 wherein the coking zone is a fluid coker.

6. The process of claim 3 wherein the high boiling stream is mixed with fresh feed coal in the liquefaction zone.

7. The process of claim 3 wherein the high boiling stream is mixed with fresh feed coal prior to entering into the liquefaction zone.

8. In a process for producing liquids from a coal feed which comprises liquefying the coal in a liquefaction zone under liquefaction conditions including the presence of hydrogen or a hydrogen donating material, recovering a liquid bottoms product from the liquefaction zone which comprises unconverted coal and coal derived liquids, passing the liquid bottoms product through a flash vessel to remove flashed liquids and thereafter passing the remainder to a coking zone and coking therein at least a portion of the bottoms product, the improvement which comprises:

A. recovering from the coking zone:
   i. a high boiling stream boiling at 1000° F.+ and having a Conradson Carbon content of at least 15 wt. %, and,
   ii. a gas oil stream boiling at a temperature of 700°–1000° F.; and, B. recycling at least a portion of the high boiling stream to said liquefaction zone.

9. The process of claim 8 wherein at least 50% of the high boiling stream being recycled to the liquefaction zone boils above about 1050° F.

10. The process of claim 8 further comprising the recovery of a recycle solvent stream boiling in the range of about 400°–700° F. from the coking zone.

11. The process of claim 9 wherein the high boiling stream from the coking zone is condensed externally to the coking zone and a portion thereof is returned to the coking zone as a quench stream for the vaporous overhead product from the coking zone.

12. The process of claim 10 wherein at least a portion of the recycle solvent stream is hydrogenated and recycled for use as hydrogen donating material.

13. A process for producing liquid from a coal feed which comprises:

(a) liquefying the coal in a liquefaction zone under liquefaction conditions including the presence of hydrogen or hydrogen donating material;
(b) recovering a liquid bottoms product from the liquefaction zone which comprises unconverted coal and coal derived liquids, passing the liquid bottoms product through a flash vessel to remove flashed liquids and thereafter passing the remainder to a coking zone and coking therein at least a portion of the bottoms product;

(c) recovering a high boiling stream boiling at a temperature of 1000° F. and having a Conradson Carbon content of at least 15 wt. % and a recycle solvent stream boiling in the range of about 400° F.-700° F. from the coking zone;

(d) hydrogenating and recycling at least a portion of the recycle solvent stream for use as hydrogen donating material; and (e) recycling at least a portion of the high boiling stream to the liquefaction zone.

14. The process of claim 13 wherein said high boiling stream is converted in said liquefaction zone into lighter boiling fractions or to fractions containing a higher hydrogen to carbon ratio.

15. The process of claim 14 further comprising the recovering of a gas oil stream boiling in the range of 700°-1000° F. from the coking zone.

16. The process of claim 15 wherein the high boiling stream from the coking zone is condensed externally to the coking zone and a portion thereof is returned to the coking zone as a quench stream for the vaporous overhead product from the coking zone.

* * * * *